United States Patent [19]

Leas

[11] 4,078,989

[45] Mar. 14, 1978

[54] COAL CONVERSION PROCESS

[75] Inventor: Arnold Marcel Leas, Columbia City, Ind.

[73] Assignee: Leas Brothers Development Corporation, Columbia City, Ind.

[21] Appl. No.: 685,232

[22] Filed: May 11, 1976

[51] Int. Cl.[2] ..... C10G 1/08

[52] U.S. Cl. ..... 208/10; 48/200; 48/210; 201/23

[58] Field of Search ..... 48/210, 200, 202, 215, 48/197 R, DIG. 4; 208/8, 9, 10; 252/373; 201/23, 38; 423/138; 23/288 R

[56] References Cited

U.S. PATENT DOCUMENTS

| | | | |
|---|---|---|---|
| 2,103,182 | 12/1937 | Rider | 48/197 R |
| 2,745,861 | 5/1956 | Bodine | 48/206 |
| 3,779,893 | 12/1973 | Leas et al. | 208/10 |
| 3,853,498 | 12/1974 | Bailie | 48/197 R |
| 3,902,856 | 9/1975 | Burroughs et al. | 23/288 R |
| 3,917,468 | 11/1975 | Van den Berg et al. | 48/215 |
| 3,920,418 | 11/1975 | Rice | 48/210 |

*Primary Examiner*—Robert L. Lindsay, Jr.
*Assistant Examiner*—George C. Yeung
*Attorney, Agent, or Firm*—Edward E. Dyson; John J. Byrne

[57] ABSTRACT

A process for the conversion of carbonaceous materials such as coal, tar sands or the like to clean liquid and gaseous fuels.

6 Claims, 1 Drawing Figure

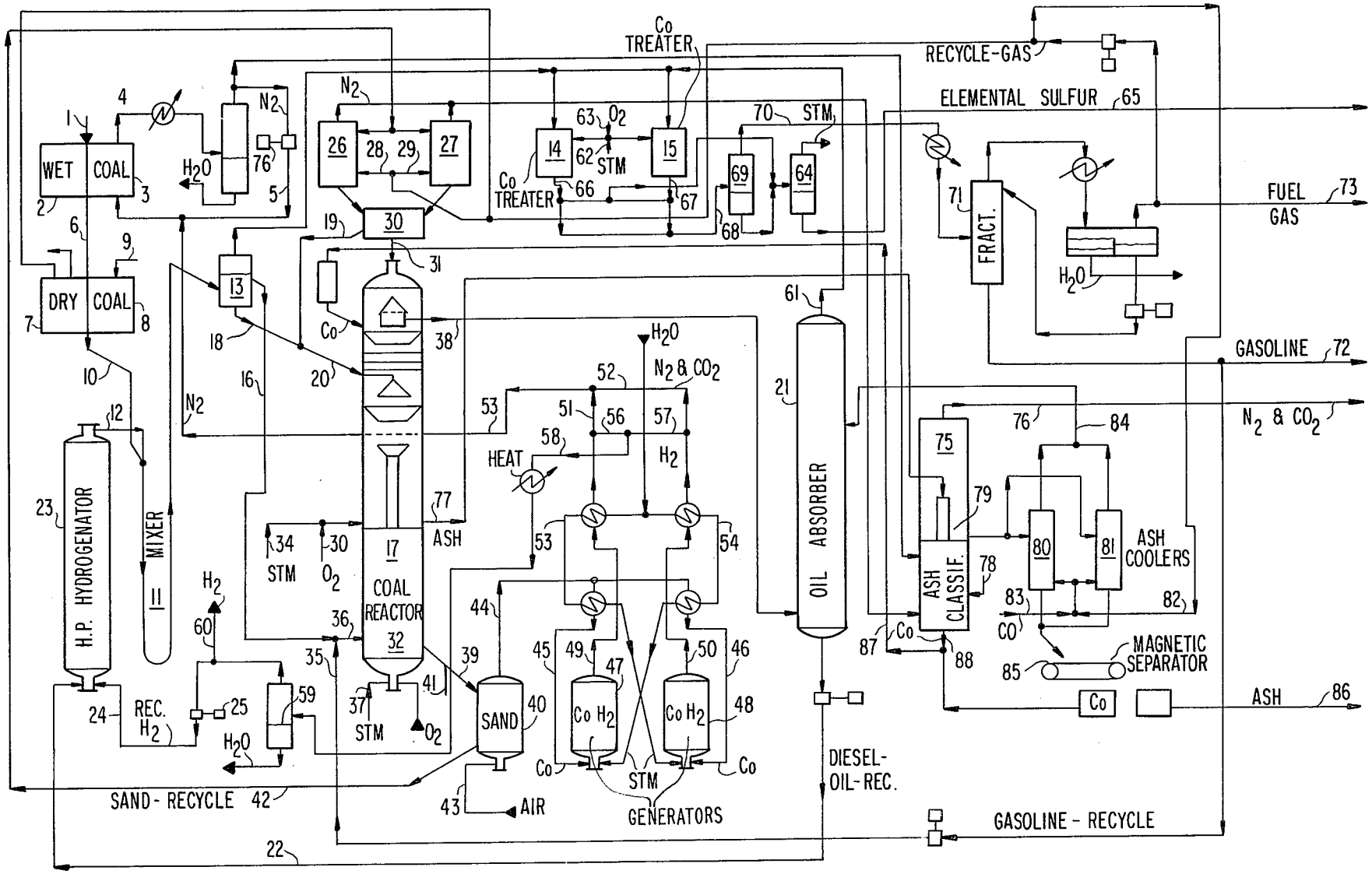
FUEL GAS
GASOLINE
$N_2$ & $CO_2$
ASH
RECYCLE-GAS
ELEMENTAL SULFUR
FRACT.
ASH COOLERS
MAGNETIC SEPARATOR
ASH CLASSIF.
GASOLINE - RECYCLE
OIL ABSORBER
DIESEL-OIL-REC.
Co TREATER
GENERATORS
SAND
AIR
HEAT
COAL REACTOR
WET COAL
DRY COAL
MIXER
H.P. HYDROGENATOR
REC. $H_2$
SAND-RECYCLE

COAL CONVERSION PROCESS

This invention relates to a process for the conversion of carbonaceous materials. More particularly, this invention relates to a process for converting coal, tar sands or the like to clean liquid and gaseous fuel products.

It is quite desirable from an economic standpoint to utilize coal to produce both gaseous and liquid fuels since coal is relatively inexpensive when compared with the cost of petroleum crude oil and is quite abundant, in contrast to the rapidly dwindling supplies of petroleum and natural gas resources.

The prior art processes and apparatus for recovering gaseous and liquid fuels from coal are quite complicated and inefficient, with the operations thereof misproportioned, with the result that the production of liquid and gaseous fuels from coal is not commensurate with the expenditures involved. Additionally, when coal is used as the source of liquid and gaseous fuels, substantial amounts of impurities or pollutants are encountered, which must be removed in order to produce clean gaseous and liquid fuels.

In the prior art, the sequence of operations is staged in complex and separate pieces of equipment with the result that considerable energy is lost between the stages. Also, in the prior art, large amounts of expensive oxygen are required. Also, the lack of use of the more active metals tend to result in a retardation of the chemical reactions which must occur and the product yields per pass are generally small. The net effect of such prior processes is a low energy yield from coal, primarily due to the inefficiencies resulting from the prior art requirement for large numbers of separate process reactors, separators and the like.

It is an object of the present invention to convert coal or tar sands into a maximum yield of clean liquid and gaseous fuels.

It is also an object of the present invention to minimize expensive oxygen or air requirements in converting coal to clean gaseous and liquid fuels.

It is a further object of the present invention to provide a process for obtaining gaseous and liquid fuels from coal whereby the emissions are essentially pollution-free.

In accordance with the present invention, a process for the conversion of carbonaceous materials to clean liquid and gaseous fuels is provided which comprises reacting an active metal catalyst, recycle fuel gas and carbonaceous material in a U-Bend mixer; separating fuel values therefrom in a gas separator; feeding unreacted or undissolved carbonaceous material and metal catalyst with hot recirculating silaceous particles to a carbonaceous material reactor at temperatures sufficiently high to remove additional fuel values from said carbonaceous material, recovering resultant ash admixed with spent metal catalyst therefrom, separating metal catalyst therefrom and recovering as metal carbonyl by reaction with carbon monoxide, converting said metal carbonyl to metal sulfide and recycling to said mixture.

In accordance with the present invention, a continuous process for the recovery of clean gaseous and liquid fuels from coal is provided, which process comprises;

(a) admixing an active metal catalyst or mixtures thereof, with recycle hydrogen and recycle solvent oil in a high pressure hydrogenator to form a slurry therein;

(b) feeding raw, crushed coal or tar sands with recycle fuel gas into the effluent stream of the high pressure hydrogenator in a U-Bend mixer and discharging the combined effluent extracted oil, solvent oil, recycle gases, undissolved coal and catalyst into a gas separator wherein the gas stream flashes off the top outlet to cobalt treating towers, the decanted oil pressures to the bottom gasifying zone in the main coal reactor, and the heavier coal-slurry-catalyst pressures to the top section of the main coal reactor;

(c) injecting hot, recirculating sand into said coal reactor, (d) mixing therewith effluent from gas separator oil and slurry-oil with the balance of the sand flow into the top of the coal reactor;

(e) maintaining temperatures within the coal reactor sufficient to decarbonize and fluidize resultant ash and metal catalyst;

(f) collecting said ash and catalyst by gravity flow in annular spaces in the middle to lower section of the coal reactor;

(g) gasifying residual carbon therefrom by the injection of steam and oxygen;

(h) pressuring ash and catalyst to an ash classifying tower, cooling, and removing heavier metal catalyst as bottoms;

(i) magnetically separating lighter metal catalyst from ash, and removing said ash;

(j) removing said light and heavy metal catalyst to react with carbon monoxide, forming metal carbonyl;

(k) feeding said metal carbonyl to an oil absorber, decomposing with heat, steam and hydrogen sulfide to an active catalyst as metal sulfide wherein the catalyst is slurried with recycle diesel oil;

(l) returning the catalyst with the oil to the high pressure hydrogenator, U-Bend mixer and coal reactor;

(m) removing sand containing residual carbon from the bottom of the coal reactor to a separate secondary carbon gasifier, converting carbon to carbon monoxide with air, removing the carbon monoxide to the cobalt-hydrogen generators, and pressuring the decarbonized sand for recycle to the coal reactor;

(n) hydrodealkylating and/or hydrocracking the heavier coal liquids into gasoline and hydrocarbon gases, vaporizing the diesel oil, solvent oil and gasoline and discharging the combined hot vapors upward through descending hot recycle sand to the bottom zone of an oil absorber;

(o) injecting oxygen and steam into the bottom of the coal reactor to heat and gasify a substantial portion of the carbon therein to carbon oxides and hydrogen, reacting said carbon oxides and hydrogen further in the coal reactor with the catalyst and unsaturated fuel to produce hydrogenated liquid and gaseous fuels discharged as hot vapors to the oil absorber;

(p) desulfurizing the hot vapors from the overhead of the oil absorber in cobalt fixed beds to remove sulfur therefrom;

(q) regenerating the cobalt beds; and (r) and recovering fuel values.

Various amounts of natural clay may be added or admixed with circulating sand to raise the fusion point of the sand as aluminum silicates.

Active metal catalysts, in addition to the preferred cobalt, are iron and nickel, which also form the carbonyls used in the present process. Mixtures of the these catalysts may also be used. Preferably, however, the catalyst is cobalt.

FIG. 1 is a diagrammatic illustration of the present invention.

Raw, crushed coal is fed by suitable conveying means 1 to fill lockbins 2 and 3. The wet coal is dried with warm nitrogen 5. Water vapor is carried with the nitrogen effluent from the top of the driers via line 4.

The dry coal is then pressured from the driers via bottom line 6 to dry coal lock-bins 7 and 8. Recycle gas from line 9 pressures the coal through line 10 to a U-Bend mixer 11 wherein the hot hydrogenated oil from line 12 extracts oil from the coal which then pressures into a separator drum 13. The gaseous overhead stream withdrawn from separator drum 13 is then pressured to cobalt treaters 14 and 15. Decanted oil is pressured through line 16 to the main coal reactor 17. The balance of the liquid oil and coal slurry are pressured through line 18 to the coal reactor 17. Hot sand from line 19 is admixed with the slurry oil prior to entry into the coal reactor 17 and the admixture is then fed into the reactor via line 20.

Recycle coal diesel oil from oil absorber 21 is pumped via line 22 to a high pressure hydrogenator tower 23. Recycle hydrogen is pressured via compressor 25 through line 24 to the hydrogenator 23.

Circulating hot sand from lock-bins 26 and 27 is pressured with recycle gas via lines 28 and 29 to the recycle sand feeder 30 and then through line 31 to the top of the coal reactor 17. As the sand flows downward in the coal reactor, it becomes uniformly coated with carbon. The carbon-coated sand gravitates to the primary gasifying zone 32. Oxygen from line 30 and steam from line 34 gasify a portion of the carbon to carbon oxides and hydrogen. Recycle gasoline from line 35 joins the coal oil from line 16 to flow to the coal reactor 17 via line 36. Atomizing steam is admitted to the bottom of the coal reactor via line 37 to improve oil cracking within the reactor. Filtered vapor leaves the top of the reactor via line 38 to the oil absorber 21. The partially decarbonated sand from the bottom of the coal reactor 17 flows through coal reactor outlet line 39 into a gasifier 40, with some sealing steam from line 41.

The decarbonated sand from 40 is pressured with nitrogen by plug flow through line 42 to sand lock-bins 26 and 27 for recycling. Air from line 43 gasifies the carbon to carbon monoxide in the gasifier 40 and the carbon monoxide is pressured, with nitrogen, through lines 44, 45 and 46 to cobalt hydrogen generators 47 and 48, where the generators undergo alternate oxidation-reduction cycles. In the reduction cycle, cobalt oxide is reduced to cobalt and the product carbon dioxide, with nitrogen, is pressured through lines 49, 50, 51, 52 and 53 to the circulating drying nitrogen line 25.

In the cobalt oxidation cycle, steam from lines 54 and 55 is decomposed to hydrogen and cobalt oxide is formed, with the hydrogen pressured through lines 49, 50, 56, 57 and 58 to a water separator 59. A portion of the hydrogen may also be removed from the system at this point via line 60.

In the oil-absorber 21, hot vaporized gasoline and fuel gas leave through line 61 and are desulfurized in fixed bed cobalt treaters 14 and 15 in alternate cycles. In the desulfurization cycle, cobalt oxide reacts with hydrogen sulfide to produce cobalt sulfide and water vapor. In a regeneration cycle steam from line 62 and minimal oxygen from line 63 are admitted to the cobalt treaters 14 and 15, reacting at a lower temperature to regenerate cobalt oxide and to produce elemental sulfur, which is removed with steam to steam-sulfur separator 64 and subsequently removed as product via 65.

The desulfurization units 14 and 15 are operated on a continuous basis with one unit undergoing regeneration as the other unit is undergoing the desulfurization cycle. In the cobalt desulfurizers phenols and ammonia are also destroyed, unsaturated hydrocarbons are hydrogenated with the free hydrogen in the vapor stream, and partial conversion of carbon monoxide to carbon dioxide is effected.

The treated gases exit the cobalt treaters 14 and 15 via lines 66, 67 and 68 to a sulfur drip pot 69 and then through line 70 to a gasoline fractionator 71. The gasoline product is discharged from the system through line 72. The fuel gas flows through lines 73 to a carbon dioxide remover from where clean fuel gas is discharged as product. The carbon dioxide remover contains an aqueous solution of sodium bicarbonate which functions to strip carbon dioxide from the gases passing therethrough.

The recycle gas is desulfurized in cobalt treaters 14 and 15 wherein the treated gas is pressured out to the sulfur drip pot 64.

The hot nitrogen vent from sand lock-bins 26 and 27 is pressured through line 74 to a power recovery wheel and then into the bottom of ash classifying tower 75. Nitrogen recycle compressor 76 recycles the dry nitrogen to pre-heaters and then to coal driers 2 and 3. The product nitrogen drives power recovery wheel and then the warm nitrogen flows to the ash classifier 75. The combined product nitrogen is discharged through an ash drier and exits the system at 76.

The ash from the coal and the catalytic cobalt leave the middle of the coal reactor 17 through hot line 77 to the top of ash classifying tower 75. Heavy coarse cobalt oxide gravitates to the bottom of the tower 75 where the safety relief gases 78 are completely burned with the hot cobalt oxide. The ash and fine cobalt powder accumulate in zone 79 and then pressure to ash coolers 80 and 81. The ash is cooled with recycle fuel gas from line 82 and carbon monoxide from line 83 with the cobalt reduced to elemental cobalt. A portion of the cobalt is gasified as cobalt carbonyl which is then pressured through line 84 to the oil absorber 21. The balance of the cobalt and ash is pressured to a magnetic separator 85 wherein the ash is removed from the system via 86 and the cobalt is returned via 87 with cobalt removed from the bottom of the coal ash classifier 75 via line 88 to the coal reactor 17.

A portion of the ash-alkali is dissolved in water in a caustic tower to remove carbon dioxide from the fuel gas and this small amount of ash-water slurry is dried.

It is apparent that the major benefits of the present invention are:

(a) better recovery and utilization of the water, hydrogen, oxygen, available liquid fuels and ash within the virgin coal, as the hydrocarbons are hydrogenated and metallic cobalt is oxidized to cobalt oxide and by reaction with water cobalt oxide and hydrogen are produced, with water also reacting with carbon monoxide to produce carbon dioxide, metallic cobalt and heat;

(b) outside oxygen requirements are substantially reduced, to about 10 per cent total, with approximately 50 per cent obtained from low cost air, and approximately 40 per cent obtained from the process steam, with an attendant increase in the purity of the hydrogen stream;

(c) the bulk of the carbon dioxide and essentially all of the nitrogen are by-passed around most of the plant thereby substantially reducing process heat which would be required from stripping out carbon dioxide from caustic solutions as in most prior art processes;

(d) safety and efficiency of coal processing is improved by charging the safety relief gases through circulating hot cobalt oxide to effect complete combustion thereof;

(e) lower maintenance costs with regard to the solvent oil pump by pumping the recycle diesel oil without a coal-slurry the coal injected via lock-bins downstream in the effluent from the high pressure oil hydrogenator tower; (f) the use of a U-Bend mixer column to extract oil from coal utilizes the pressure let-down from the hydrogenator tower for mixing with hydrogenated solvent oil and excess recycle hydrogen gas and increasing coal-hydrogen contact;

(g) cobalt catalyst is regenerated as the gaseous carbonyl in the normal course of recycling catalyst, with cobalt tetroxide reacting with carbon monoxide to yield the cobalt carbonyl in the ash coolers, and in the oil absorber cobalt carbonyl reacting with water to yield metallic cobalt, carbon monoxide the metallic cobalt reacting with water to produce cobalt oxide and hydrogen and/or hydrocarbons reacting with hydrogen and cobalt to produce hydrogenated hydrocarbons and cobalt oxide, with the cobalt oxide reacting with hydrogen sulfide to produce cobalt sulfide and water;

(h) the sand cracking of the coal and liquid fuel products prior to destroying the virgin coal hydrocarbon bonding produces more marketable liquid fuels;

(i) pure carbon is produced for more than one stage-gasification by transferring the coke on the circulating sand granules to produce several purity products with different gasifying agents, with carbon reacting with air to yield carbon monoxide, carbon dioxide, nitrogen and heat; with pure oxygen to yield carbon monoxide, carbon dioxide and heat; with water to yield carbon monoxide, carbon dioxide and hydrogen; and with carbon monoxide to yield carbon dioxide and carbon black;

(j) higher heat content fuel gas is produced without the use of a separate methanization unit to convert producer gas by $$C_{10}H_8 - C_3H_6 + H_2 \rightarrow C_{10}H_8 + C_3H_8$$

with $C_3H_8$ at 2500 BTU/ft$^3$;

(k) the purity of hydrogen produced is enhanced by the use of cobalt;

(l) the hot sand stream circulating continuously through the coal reactor and carbon gasifier distributes process heat, keeps the coal reactor clean, improves contact and increases reaction rates, improves recovery and separation of the coal ash and the catalyst, improves the filtration and cleaning of the reactor top filter, and aids in the monitoring and controlling of the operating variables within the coal reactor;

(m) the process permits of the use of coal having widely varying qualities and reactivities; and (n) to the extent that liquids are extracted from the coal, less oxygen is required and smaller equipment is needed in view of the greater density of liquids compared to that of gases, and considerably less plant operating pressure is required when producing liquid fuels from coal. It is desirable to produce both liquid and gaseous fuels from coal simultaneously, from an economic standpoint, since nearly all coal contains some elemental carbon and the expenses involved in total liquid recovery from coal renders such impractical. Additionally, some pure carbon is required to combine with steam to produce hydrogen and heat.

The present process is designed to accomodate any grade of coal. The following table sets forth the key operating variables for the present process. Unless otherwise specified, pressure is expressed in points per square inch (lb/in$^2$) and temperature is expressed in ° F.

| UNIT | RANGE | PREFERRED |
|---|---|---|
| Coal Reactor | | |
| Pressure | 10–1000 | 100–300 |
| Top temperature | 500–1200 | 700–1000 |
| Ash draw temperature | 1000–1900 | 1200–1600 |
| Bottom gasifier temperature | 1200–2000 | 1400–1600 |
| Sand/coal ratio | 1–10 | 2–3 |
| High Pressure Hydrogenator | | |
| Top temperature | 600–1000 | 750–900 |
| Pressure | 200–2000 | 400–700 |
| Hydrogen/oil mol ratio | 1–10 | 2–4 |
| Cobalt/coal ratio | 0.01–0.33 | 0.05–0.15 |
| Oil Absorber | | |
| Pressure | 10–1000 | 100–300 |
| Top temperature | 300–1000 | 500–850 |
| Cobalt Desulfurizer | | |
| Pressure | 10–1000 | 100–300 |
| Treating temperature | 400–1000 | 600–800 |
| Regenerating temperature | 300–600 | 400–500 |
| Carbon Gasifier | | |
| Pressure | 10–1000 | 100–300 |
| Temperature | 1300–2200 | 1500–1800 |
| Cobalt Hydrogen Generator | | |
| Pressure | 10–1000 | 100–300 |
| Reduction cycle temperature | 1300–2000 | 1500–1800 |
| Oxidation cycle temperature | 1300–2000 | 1400–1700 |
| Coal Drying | | |
| Pressure | 10–400 | 50–200 |
| Temperature | 100–400 | 200–300 |
| U-Bend Mixer | | |
| Pressure drop | 50–500 | 200–300 |
| Temperature | 500–900 | 700–800 |
| Ash Classifier Tower | | |
| Pressure | 5–50 | 15–30 |
| Temperature, bottom zone | 400–1000 | 600–800 |
| Temperature, top zone | 400–800 | 500–600 |
| Temperature, ash draw | 400–1000 | 600–800 |

| Product Yields (Bench and Pilot Plant) | Average | Range |
|---|---|---|
| Distillate liquid fuels per cent of coal energy | 45 | 10–65 |
| Gaseous fuels per cent of coal energy | 30 | 65–10 |
| Conversion efficiency per cent of coal energy | 75 | 65–80 |
| Gaseous fuel heat content BTU/ft$^3$ | 500–1000 | 100–2000 |

While there have been disclosed effective embodiments of the present invention, it is to be understood that the invention is not limited to such embodiments and changes may be made therein without departing from the scope and spirit of the invention.

I claim:

1. A continuous process for the recovery of clean gaseous and liquid fuels from coal which comprises:

(a) admixing an active metal catalyst, or mixtures thereof, with recycle hydrogen and recycle solvent oil in a high pressure hydrogenator to form a slurry therein;

(b) feeding raw, crushed coal with recycle fuel gas into the effluent stream of said high pressure hydrogenator in a U-Bend mixer operated at a temperature of from about 500° to 900° F and at a pressure drop of from about 50 lb./in.$^2$ to about 500 lb./in.$^2$ and discharging the resultant U-Bend mixer effluent into a gas separator wherein the gas stream is flashed off the top outlet to cobalt treating towers, decanted oil is pressured to the bottom gasifying zone in a main coal reactor, and heavier coal-slurry-catalyst is pressured to the top of said main coal reactor;

(c) injecting hot, recirculating sand into said coal reactor;

(d) mixing therewith effluent from gas separator oil and slurry-oil with the balance of the sand flow into the top of said main coal reactor;

(e) maintaining temperatures within said main coal reactor sufficient to decarbonize and fluidize resultant ash and metal catalyst;

(f) collecting said ash and said catalyst by gravity flow in annular spaces in the mid to lower portion of said main coal reactor;

(g) gasifying residual carbon therefrom by the injection of steam and oxygen;

(h) pressuring said ash and said catalyst to an ash classifying tower, cooling and removing heavier metal catalyst as bottoms;

(i) magnetically separating lighter metal catalyst from said ash, and removing said ash from the system;

(j) removing said light and heavy metal catalyst to react with carbon monoxide, forming metal carbonyl;

(k) feeding said metal carbonyl to an oil absorber, decomposing metal carbonyl with heat, steam and hydrogen sulfide to an active catalyst as metal sulfide wherein said catalyst is slurried with recycle diesel oil;

(l) returning said catalyst with said oil to said high pressure hydrogenator, U-Bend mixer and main coal reactor;

(m) removing sand containing residual carbon from the bottom of said main coal reactor to a separate carbon gasifier, converting carbon to carbon monoxide with air, removing said carbon monoxide to the cobalt-hydrogen generators, and pressuring the decarbonized sand for recycle to said main coal reactor;

(n) hydrodealkylating and hydrocracking heavier coal liquids into gasoline and hydrocarbon gases, vaporizing diesel oil, solvent oil and gasoline and discharging the combined hot vapors upward;

(o) injecting oxygen and steam into the bottom of said coal reactor to heat and gasify a substantial portion of the carbon therein the carbon oxides and hydrogen, reacting said carbon oxides and hydrogen further in said main coal reactor with metal catalyst and unsaturated fuel values to produce hydrogenated liquid and gaseous fuels discharged as hot vapors to said oil absorber;

(p) desulfurizing said hot vapors in cobalt fixed beds to remove sulfur therefrom;

(q) regnerating said cobalt beds on a cycle basis; and (r) removing the gas stream flashed off the top outlet of the gas separator of step (b) and recovering gaseous and liquid fuels therefrom.

2. The process of claim 1 wherein clay is admixed with said circulating sand.

3. The process of claim 1 wherein said metal catalyst is selected from the group consisting of cobalt, iron, nickel, and mixtures thereof.

4. The process of claim 3 wherein said metal catalyst is cobalt.

5. The process of claim 1 wherein cobalt is reduced with carbon monoxide and cyclically oxidized with steam to generate hydrogen.

6. The process of claim 1, wherein the fuel gas and gasoline are recovered from the combined hot vapors of step (m) and the gas stream flashed off the top outlet of the gas separator of step (b).

* * * * *